US008499768B1

(12) United States Patent
Pheng

(10) Patent No.: US 8,499,768 B1
(45) Date of Patent: Aug. 6, 2013

(54) NAIL TOOL HOLDER AND KIT

(76) Inventor: Chanty Pheng, Cranston, RI (US)

( * ) Notice: Subject to any disclaimer, the term of this patent is extended or adjusted under 35 U.S.C. 154(b) by 0 days.

(21) Appl. No.: 13/352,467

(22) Filed: Jan. 18, 2012

Related U.S. Application Data

(63) Continuation-in-part of application No. 13/079,094, filed on Apr. 4, 2011, now abandoned.

(51) Int. Cl.
*A45D 29/18* (2006.01)
*A45D 29/20* (2006.01)

(52) U.S. Cl.
USPC ..... 132/73.5; 132/75

(58) Field of Classification Search
USPC ..... 132/73.5, 75, 74.5, 76.5; 206/581, 206/823, 362; 422/300, 301, 311, 310
See application file for complete search history.

(56) References Cited

U.S. PATENT DOCUMENTS

| | | | | | |
|---|---|---|---|---|---|
| 1,585,215 | A * | 5/1926 | Taylor | 422/301 |
| 1,767,034 | A * | 6/1930 | Andresen | 422/301 |
| 1,979,241 | A * | 11/1934 | Albanese et al. | 206/362 |
| 2,786,245 | A * | 3/1957 | Steinbock, Jr. | 422/310 |
| 3,347,346 | A * | 10/1967 | Young | 190/110 |
| 3,966,408 | A * | 6/1976 | Drennen et al. | 422/301 |
| 4,135,868 | A * | 1/1979 | Schainholz | 422/310 |
| 5,628,971 | A * | 5/1997 | Norman | 422/301 |
| 6,244,447 | B1 * | 6/2001 | Frieze et al. | 211/85.13 |
| 6,481,577 | B1 | 11/2002 | Roegner | |
| 6,574,983 | B2 * | 6/2003 | Smith et al. | 62/372 |
| 6,647,988 | B2 | 11/2003 | Christianson | |
| 6,832,688 | B1 | 12/2004 | Rivera et al. | |
| 7,100,620 | B2 | 9/2006 | Fung | |
| 7,434,410 | B2 * | 10/2008 | Ford | 62/62 |
| 2005/0279123 | A1 * | 12/2005 | Maldonado et al. | 62/457.7 |
| 2007/0258874 | A1 | 11/2007 | Vuong | |

* cited by examiner

*Primary Examiner* — Robyn Doan
(74) *Attorney, Agent, or Firm* — Salter & Michaelson

(57) ABSTRACT

A nail tool holder includes a container having a container base and a lid assembly that together form a storage chamber for nail tools. The container preferably includes a cleaning solution at the bottom of the chamber, means for supporting at least one nail tool from the lid assembly so that the nail tool can be supported at a handle thereof and with the lid assembly including an intermediate piece and a cover piece. A support bar extends outwardly from a container sidewall in a pivotal manner.

20 Claims, 18 Drawing Sheets

NAIL TOOL HOLDER AND KIT

RELATED CASE

Priority for this application is hereby claimed under 35 U.S.C. §119(e) to commonly owned and co-pending U.S. patent application Ser. No. 13/079,094 which was filed on Apr. 4, 2011 and which is incorporated by reference herein in its entirety.

FIELD OF THE INVENTION

The present invention relates in general to a nail tool holder for retaining certain tools used in performing manicures or pedicures. The present invention also relates to a container for such tools that enables the tools to be stored and cleaned.

BACKGROUND OF THE INVENTION

In performing manicures and pedicures, a number of different types of tools may be employed including, but not limited to, a nail clipper. At the present time there is no convenient means for storing such tools and, moreover, it is typical for the tools to be re-used many times without proper cleaning thereof.

Accordingly, it is an object of the present invention to provide a nail tool holder that is preferably in the form of a container for supporting a variety of different types of nail tools including, but not limited to, clippers and brushes.

Another object of the present invention is to provide a nail tool kit that includes a container as well as the various tools that are stored in and for cleaning in the container.

Still another object of the present invention is to provide a nail tool holder that is relatively simple in construction, that can be manufactured inexpensively and that is provided with a number of important features that enable a variety of nail tools to be supported thereby.

SUMMARY OF THE INVENTION

To accomplish the foregoing and other objects, features and advantages of the present invention there is provided a nail tool holder comprising: a container that includes a container base and a lid assembly that together form a storage chamber for nail tools including, but not limited to, a fingernail clipper; the container containing a cleaning solution at a bottom of the chamber; means for supporting at least one nail tool from the lid assembly so that the nail tool can be supported at a handle of the nail tool; the lid assembly including an intermediate piece and a cover piece that is movable relative to said intermediate piece; and means for enabling adjustment of the intermediate piece to different heights above the container base.

In accordance with other aspects of the present invention the means for supporting the nail tool includes a plurality of fingers extending from a sidewall of the intermediate piece; including opposite sets of fingers extending from opposite sidewalls of the intermediate piece; wherein the fingers of both sets are spaced from each other along the respective sidewall so that the handle of a nail tool can be supported between adjacent fingers with the tip of the nail tool directed downwardly; wherein the fingers are adjustable relative to the spacing therebetween so as to accommodate different size nail tools; wherein said cover piece is movable relative to said intermediate piece by including a hinge for supporting said cover piece from said intermediate piece; wherein said means for enabling adjustment includes an extension arm depending downwardly from the intermediate piece so that the intermediate piece can be moved to different elevations over the container base; including a receiver attached to the container base for engaging with the receiver; and including a fastener for holding the extension arm at a predetermined elevation.

In accordance with another version of the present invention there is provided a nail tool holder comprising: a container that includes a container base and a lid assembly that together form a storage chamber for nail tools including, but not limited to, a fingernail clipper; a finger array for supporting at least one nail tool from the lid assembly so that the nail tool can be supported at a handle of the nail tool; the lid assembly including an intermediate piece and a cover piece that is movable relative to said intermediate piece; the finger array supported from said intermediate piece; and a coupling member that is arranged between the intermediate piece and the container base for enabling adjustment of the intermediate piece to different heights above the container base.

In accordance with still other aspects of the present invention the container contains a cleaning solution at a bottom of the chamber; wherein the finger array includes a plurality of fingers extending from a sidewall of the intermediate piece including opposite sets of fingers extending from opposite sidewalls of the intermediate piece, and wherein the fingers of both sets are spaced from each other along the respective sidewall so that the handle of a nail tool can be supported between adjacent fingers with the tip of the nail tool directed downwardly; wherein the fingers are adjustable relative to the spacing therebetween so as to accommodate different size nail tools; wherein said cover piece is movable relative to said intermediate piece by including a hinge for supporting said cover piece from said intermediate piece; wherein said coupling member enables adjustment and includes an extension arm depending downwardly from the intermediate piece so that the intermediate piece can be moved to different elevations over the container base; including a receiver attached to the container base for engaging with the receiver; and including a fastener for holding the extension arm at a predetermined elevation.

In accordance with another embodiment of the present invention there is provided a kit for nail tools comprising: a container that includes a container base and a lid assembly that together form a storage chamber for nail tools; a finger array for supporting at least one nail tool from the lid assembly so that the nail tool can be supported at a handle of the nail tool; the lid assembly including an intermediate piece and a cover piece that is movable relative to said intermediate piece; the finger array supported from said intermediate piece including opposite sets of fingers extending from opposite sidewalls of the intermediate piece, and wherein the fingers of both sets are spaced from each other along the respective sidewall so that the handle of a nail tool can be supported between adjacent fingers with the tip of the nail tool directed downwardly; a coupling member that is arranged between the intermediate piece and the container base for enabling adjustment of the intermediate piece to different heights above the container base; at least one nail clipper supported between adjacent fingers and extending toward a bottom of the chamber; and at least compartment on the outer surface of the container base for holding a nail brush;

In accordance with still other aspects of the present invention the coupling member enables adjustment and includes an extension arm depending downwardly from the intermediate piece so that the intermediate piece can be moved to different elevations over the container base; and including two oppositely disposed compartments on the container base for accommodating respective nail tools.

In accordance with another embodiment of the present invention there is provided a nail tool holder that is comprised of: a container that includes a container base and a lid assembly that together form a storage chamber for nail tools including, but not limited to, a fingernail clipper, and a slotted structure for supporting at least one nail tool from the lid assembly so that the nail tool can be supported at a handle of the nail tool. The lid assembly includes an intermediate piece and a cover piece that is movable relative to said intermediate piece. The slotted structure is supported from the intermediate piece, and further including a support bar that extends from a container sidewall.

In accordance with other aspects of the present invention, the container may be used to contain a cleaning solution at a bottom of the chamber; the slotted structure includes a plurality of fingers extending from a sidewall of the intermediate piece including opposite sets of fingers extending from opposite sidewalls of the intermediate piece, and wherein the fingers of both sets are spaced from each other along the respective sidewall so that the handle of a nail tool can be supported between adjacent fingers with the tip of the nail tool directed downwardly; the slotted structure defines a plurality of parallel disposed slots with at least one of said slots extending in a continuous loop, and at least one other slot is interrupted to define fingers that extend toward each other; the support bar is pivotally supported from a sidewall of the intermediate piece; including a shelf disposed in the container base spaced above a bottom of the container base and positioned relative to the slotted structure so that a tool supported by said slotted structure rests on said shelf; and including a pair of side compartments supported from a sidewall for the container base for holding tools outside of the container base.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to the accompanying drawings for illustrations of embodiments of the present invention. This includes a first embodiment illustrated in FIGS. 1-10; an alternate portion of the structure for adjusting the position of fingers shown in FIGS. 11-14; a second embodiment of the present invention illustrated in FIGS. 15-18; and still another embodiment of the present invention illustrated in FIGS. 19-22.

Figure 1:
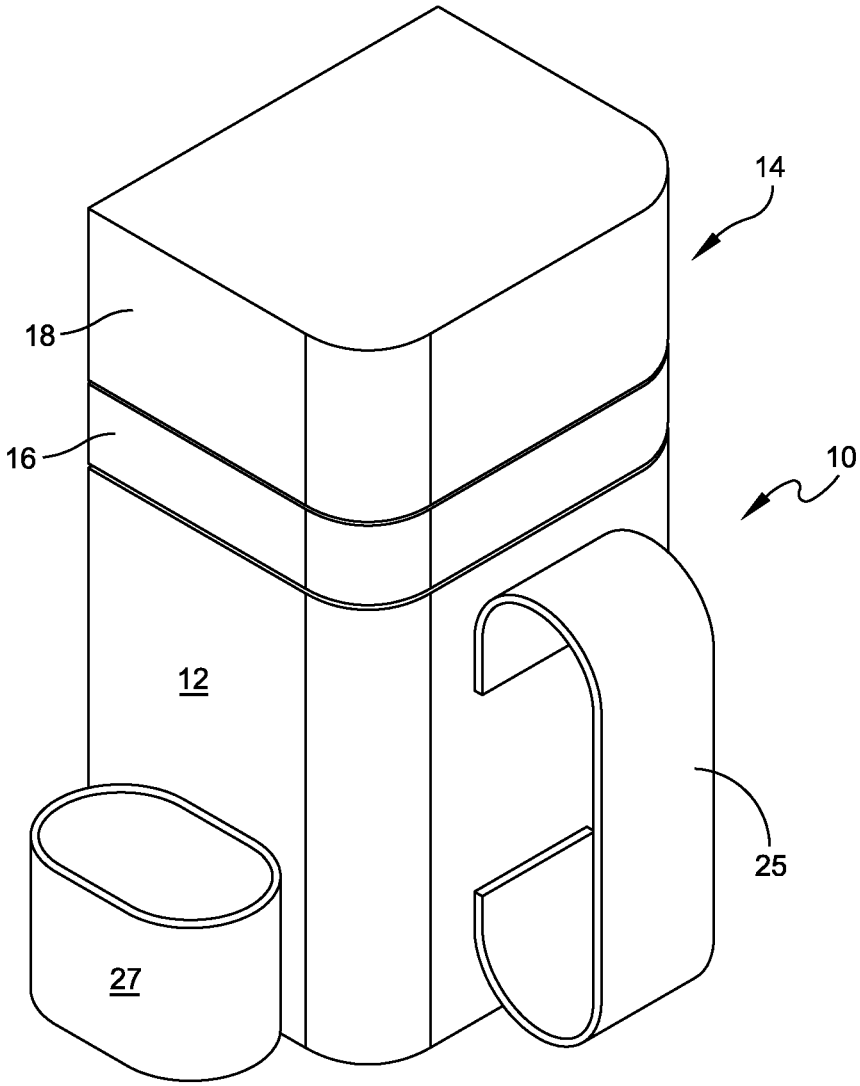
FIG. 1 is a perspective view of one embodiment of the nail tool holder of the present invention with the holder in a closed position.

Reference is now made to the first embodiment illustrated in FIGS. 1-10. The nail tool holder is comprised of a container 10 that is preferably constructed of a lightweight plastic material. The container 10 includes a container base 12 and a lid assembly 14. In accordance with one feature of the present invention, the lid assembly is comprised of an intermediate piece 16 and a cover piece 18. Preferably, the container base, as well as the intermediate and cover pieces, are all generally of the same cross-sectional shape as illustrated in FIG. 1 so that the lid assembly 14 mates effectively with the container base 12.

Refer to FIGS. 1-5 for a description of the container base, the intermediate piece and the cover piece, each having multiple contiguously connected walls forming an upper peripheral substantially planar edge that define therebetween part of the chamber area. As noted, for example, in FIG. 5, the footprint of the base, intermediate piece and cover piece are substantially the same.

Figure 4:
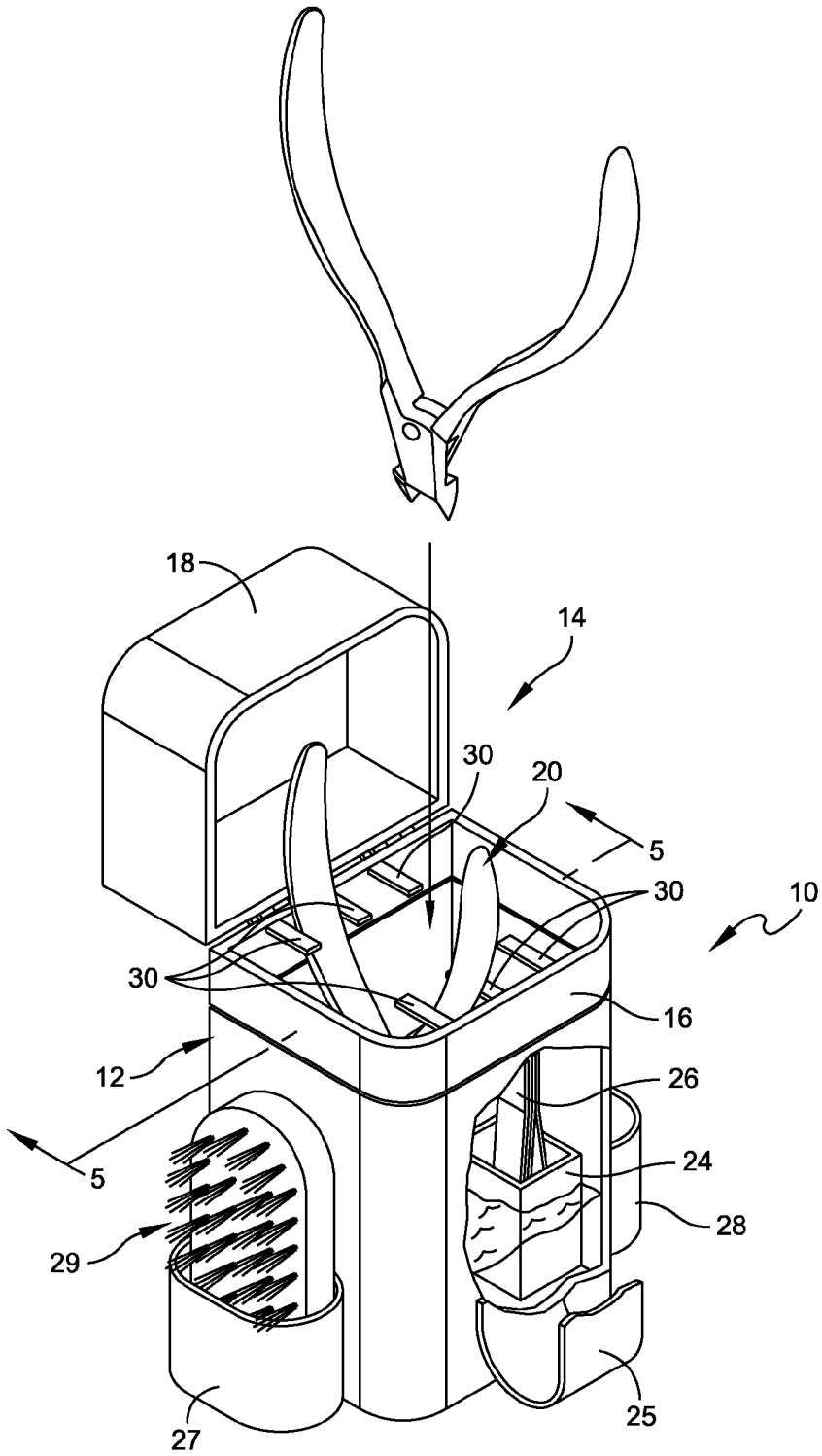
FIG. 4 is a perspective view of the holder in an open position further illustrating tools supported by the holder.
Figure 5:
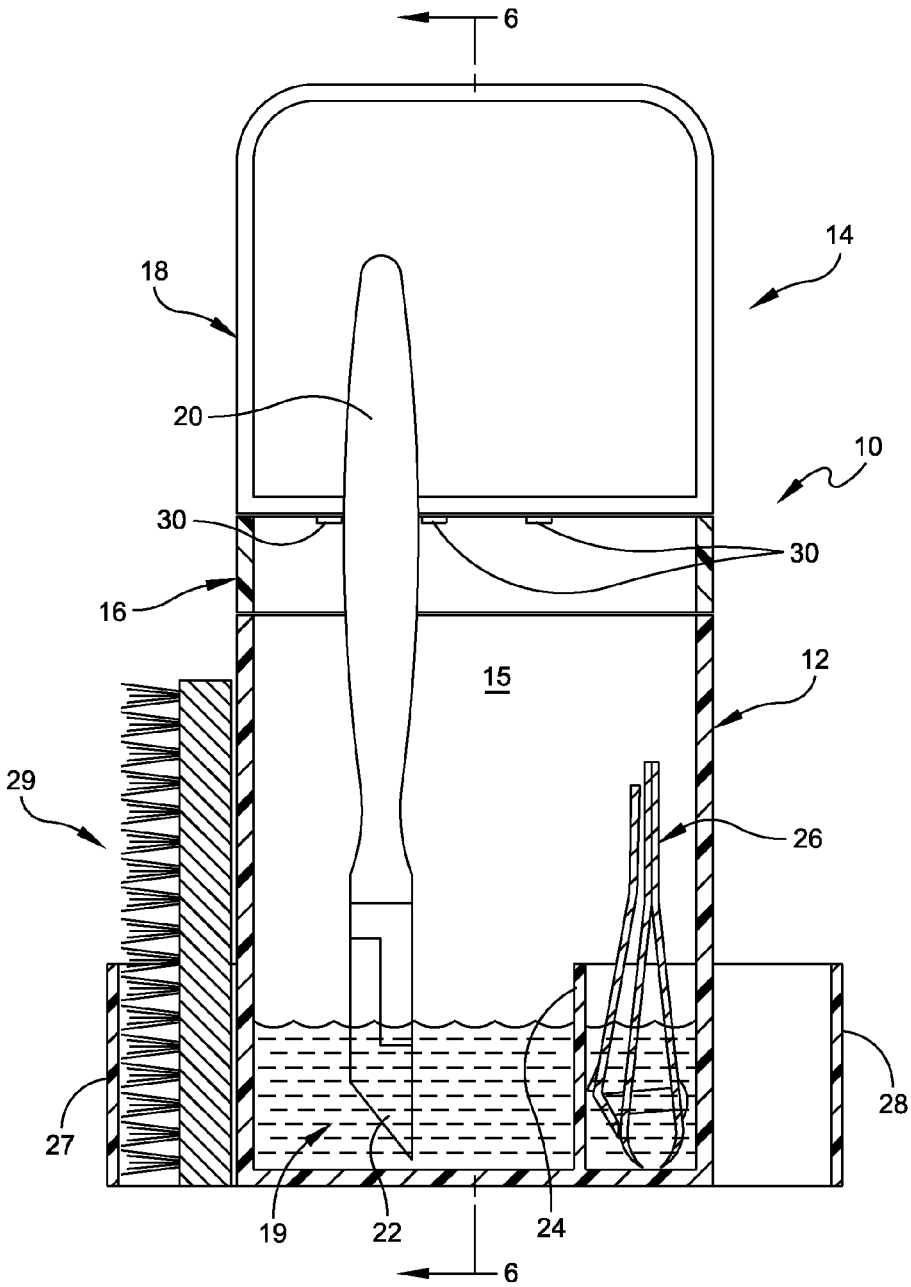
FIG. 5 is a cross-sectional view taken along line 5-5 of FIG. 4.
Figure 6:
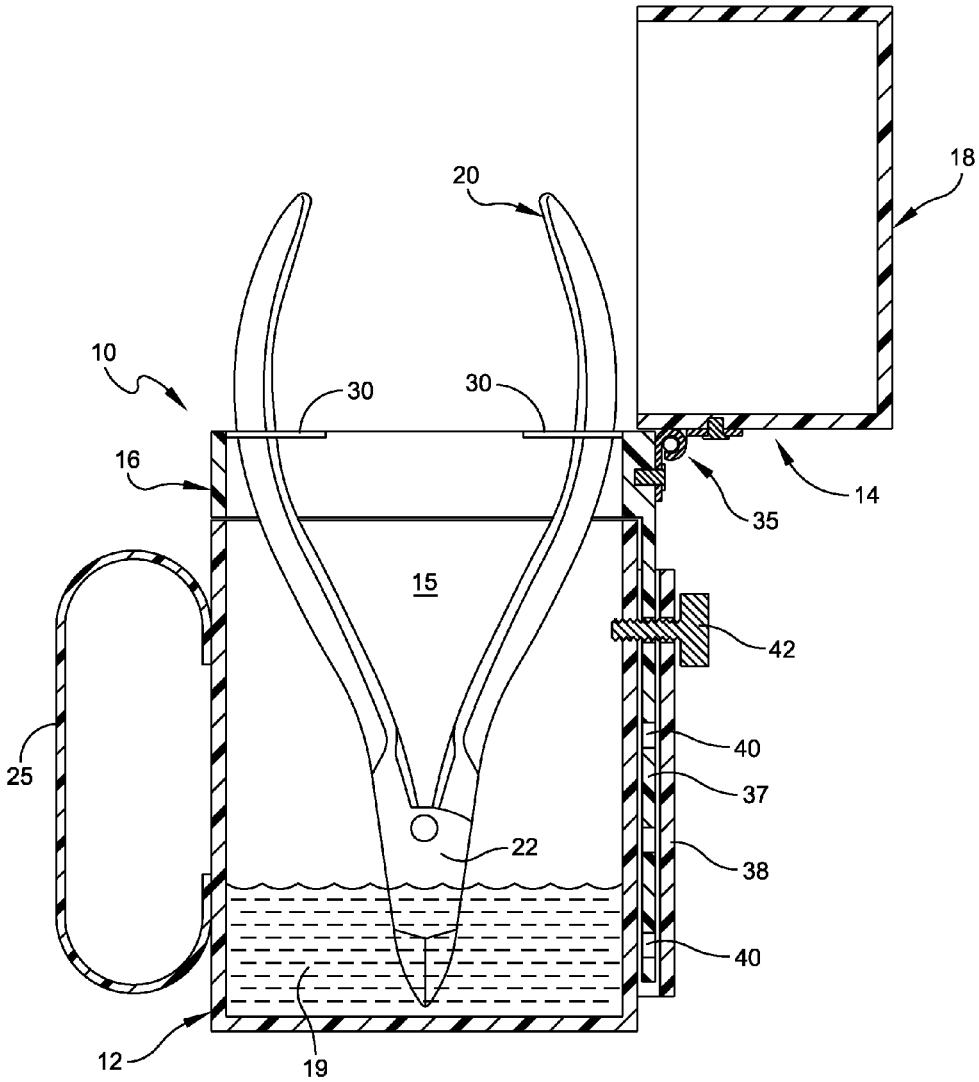
FIG. 6 is a cross-sectional view taken along line 6-6 of FIG. 5.

The container base 12 and the lid assembly 14 together form an internal storage chamber 15 for accommodating nail tools that include, but are not limited to, a fingernail clipper, such as the one illustrated in FIGS. 4-6. The storage chamber, particularly at the container base 12 forms a reservoir for containing a cleaning solution 19. In this regard refer to the cross-sectional views of FIGS. 5 and 6 that illustrate the cleaning solution at 19 at the bottom of the container base 12.

Various types of cleaning solutions may be employed for cleaning and sterilizing, particularly the tip 22 of the conventional nail clipper 20. Once again, refer to FIGS. 5 and 6. As also noted in FIGS. 4 and 6, within the chamber 15 there may be provided a separate holder 24. FIG. 5 illustrates a small nail clipper 26 supported within the small holder 24. Preferably, the cleaning solution 19 is also permitted to flow into the smaller holder 24. Through ports may be provided in a sidewall thereof.

Figure 2:
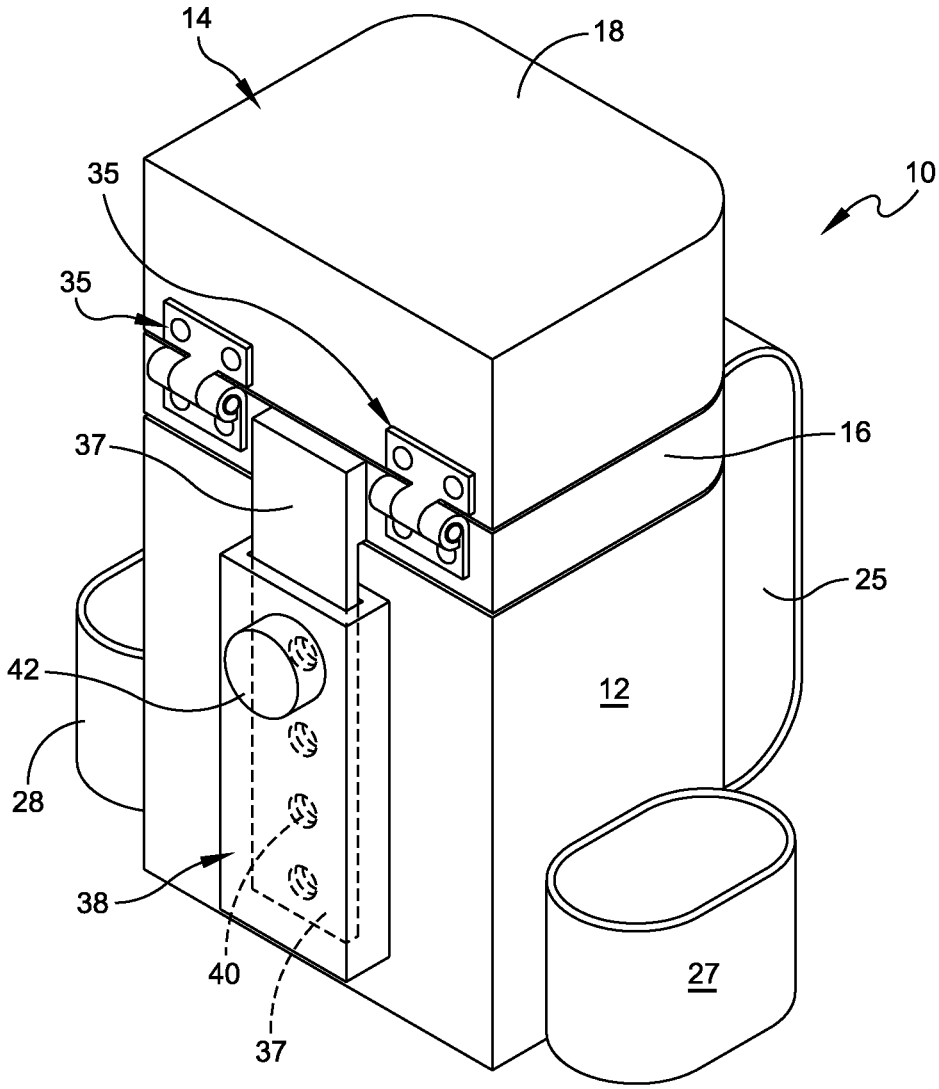
FIG. 2 is a perspective view of the holder of FIG. 1 taken from the rear of the holder.
Figure 3:
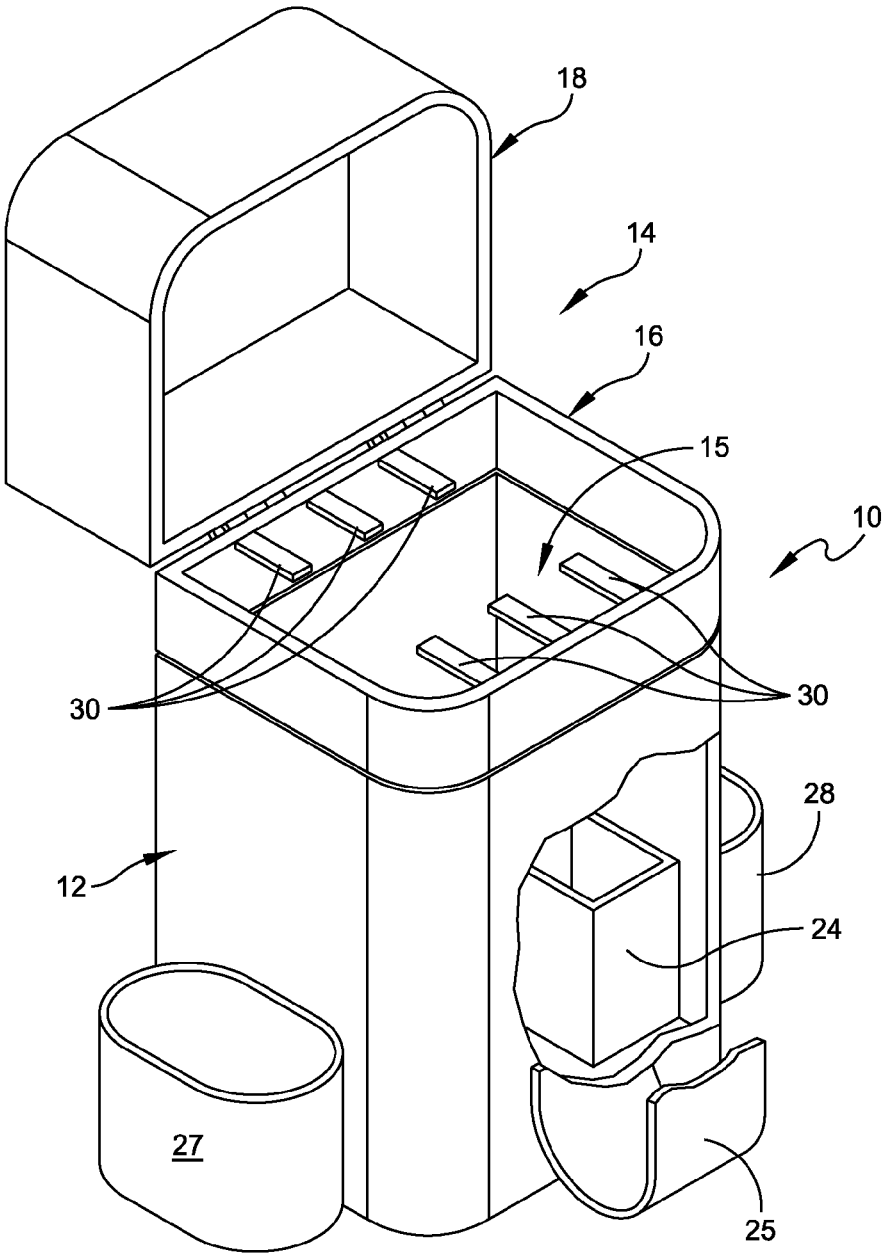
FIG. 3 is a perspective view of the holder of FIGS. 1 and 2 with the holder in an open position.

As illustrated in FIG. 1, the container base 12 is also preferably provided with a handle 25, and as illustrated in FIGS. 2 and 3, sidewalls of the container base 12 support separate compartments 27 and 28. Each of these compartments is formed of a somewhat oval-shaped wall structure with the wall attached in a known manner to a respective sidewall. The compartments 27 and 28 are preferably also constructed of a plastic material and the material may be either rigid or may be a flexible material. In this regard refer to FIGS. 4 and 5 for an illustration of a small brush 29 that is illustrated as supported within the compartment 27. The compartment 27 may have a sidewall of various height. In the embodiment of FIG. 5, the brush 29 extends over the top of the compartment 27.

Means are provided for supporting at least one nail tool from the lid assembly 14 so that the nail tool can be supported at a handle of the nail tool. In this regard refer to the cross-sectional view of FIG. 6 which illustrates the nail clipper 20 supported at the lid assembly 14. Refer also to the perspective view of FIG. 4 which illustrates the clipper 20 supported by means of oppositely disposed sets of fingers 30. FIG. 4 illustrates the nail clipper 20 having opposite arms supported between adjacently disposed fingers 30. The fingers 30 may be fixed to opposed respective sidewalls at inner surfaces thereof. Each of the fingers 30 is supported from the intermediate piece 16. FIG. 4 illustrates the clippers 20 in two positions. In the upper position the clippers have not yet been inserted into the container and in the lower position the clippers are shown supported within the container between the fingers 30. FIG. 5 also shows the support of the nail clipper with the tip 22 thereof in the cleaning solution 19. FIG. 6 also shows the support between the fingers 30. FIG. 3 illustrates the container with the lid assembly 14 having the fingers 30 extending from opposite sidewalls of the intermediate piece 16.

As indicated previously, the lid assembly 14 is comprised of an intermediate piece 16 and a mating cover piece 18. The cover piece 18 is moveable relative to the intermediate piece and for this purpose there are provided a pair of hinges 35 as illustrated in FIGS. 2 and 6-8. These may be conventional hinges with one side secured to the intermediate piece 16 and the other side secured to a flat sidewall of the cover piece 18. FIG. 2 illustrates the hinges 35 with the lid assembly in its closed position. In other words, in that position the cover piece 18 is hinged downwardly for engagement with the intermediate piece 16. FIG. 3, on the other hand, illustrates the cover piece 18 opened at the hinges so as to provide ready access to the container. FIG. 4 also illustrates the cover piece 18 hinged to an open position. Furthermore, FIG. 6 illustrates a cross-section through the hinge 35 illustrating the connection to the intermediate piece 16 and the cover piece 18. In FIG. 6, the cover piece 18 is shown in its open position. The cross-sectional view of FIGS. 7 and 8 also illustrate the construction of the hinge 35.

Figure 7:
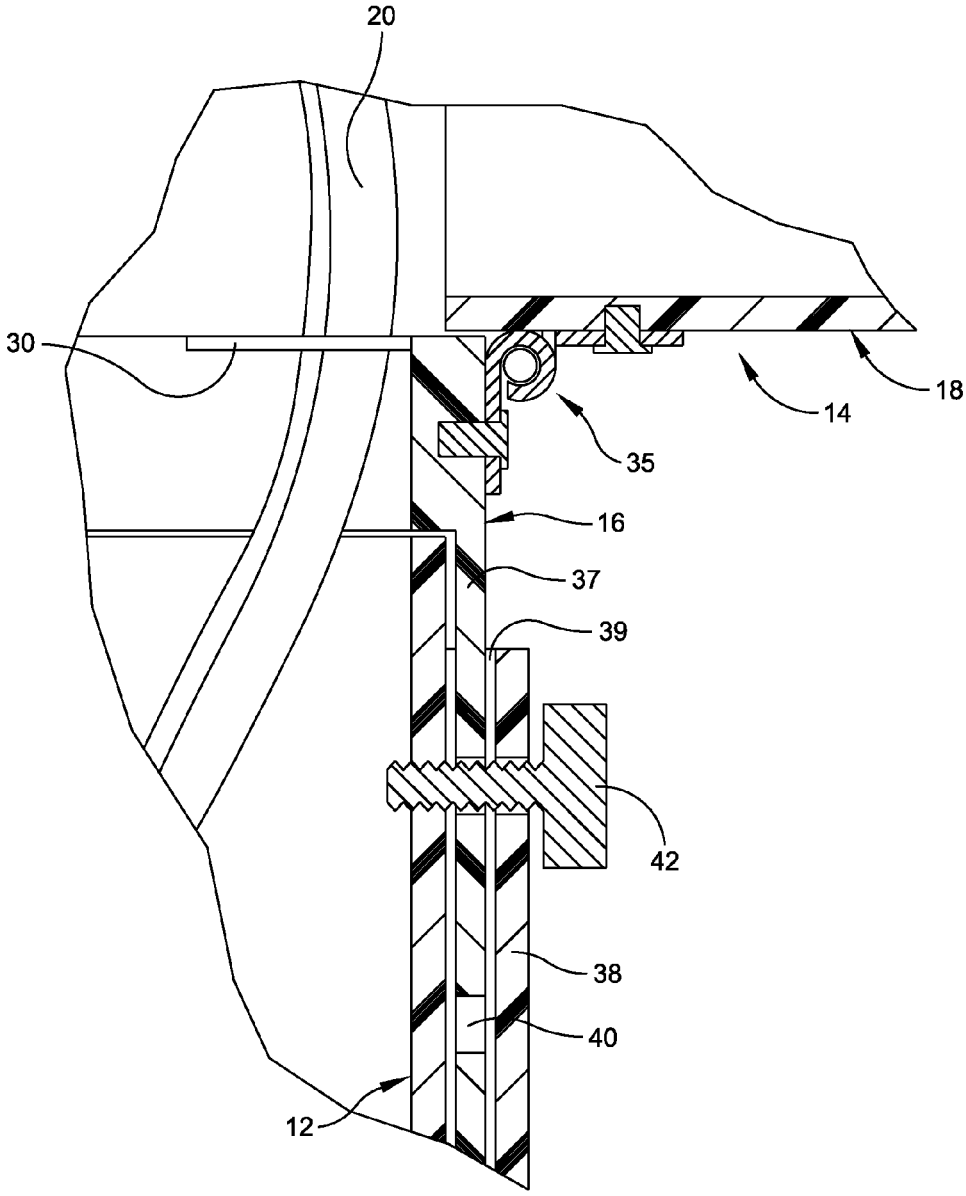
FIG. 7 is a fragmentary cross-sectional view of a portion of the holder.
Figure 8:
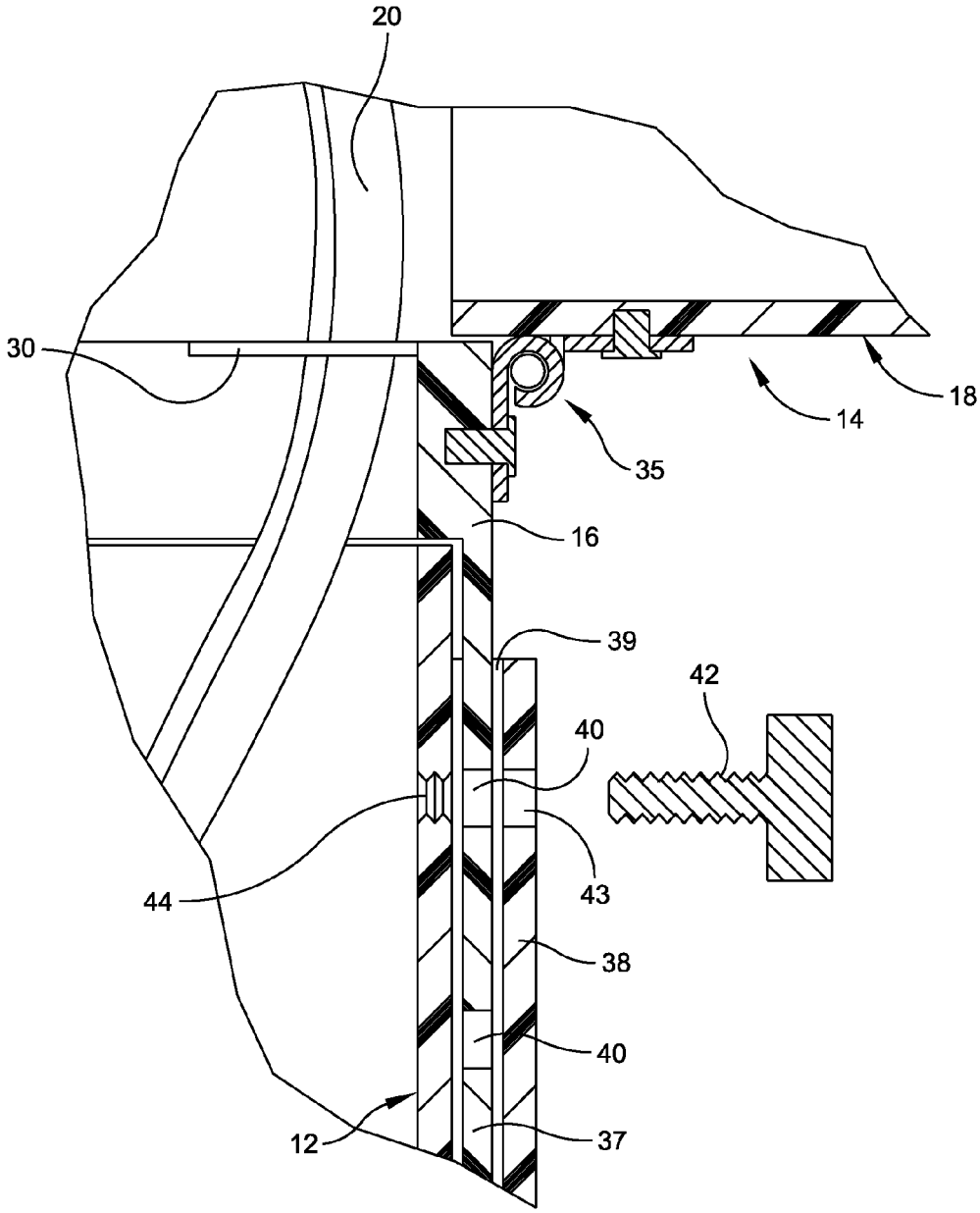
FIG. 8 is a fragmentary cross-sectional view similar to that shown in FIG. 7 but with the adjusting screw removed.

In accordance with another feature of the present invention, there is provided a means for enabling adjustment of the lid assembly to different heights above the container base. In the first embodiment of the present invention, this is illustrated by the incorporation of a downwardly extending extension 37 as depicted in the rear perspective view of FIG. 2. The downwardly depending extension 37 is meant to engage with the slide retainer 38. The retainer 38 is fixed to the flat rear sidewall of the container base and is provided with a slot 39 for receiving the extension 37. The extension 37 is provided with a series of spaced holes as illustrated in FIGS. 2 and 6-9. A fastener 42 may be threaded with a hole 43 in the retainer 38 or, as illustrated, the end of the fastener 42 is actually threadedly engaged with a sidewall of the container base 12. The internally threaded hole is illustrated at 44 in a sidewall of the container base. The fastener 42 may be of conventional design and can be easily screwed into position such as shown in FIG. 7 or removed such as illustrated in FIG. 8.

Figure 9:
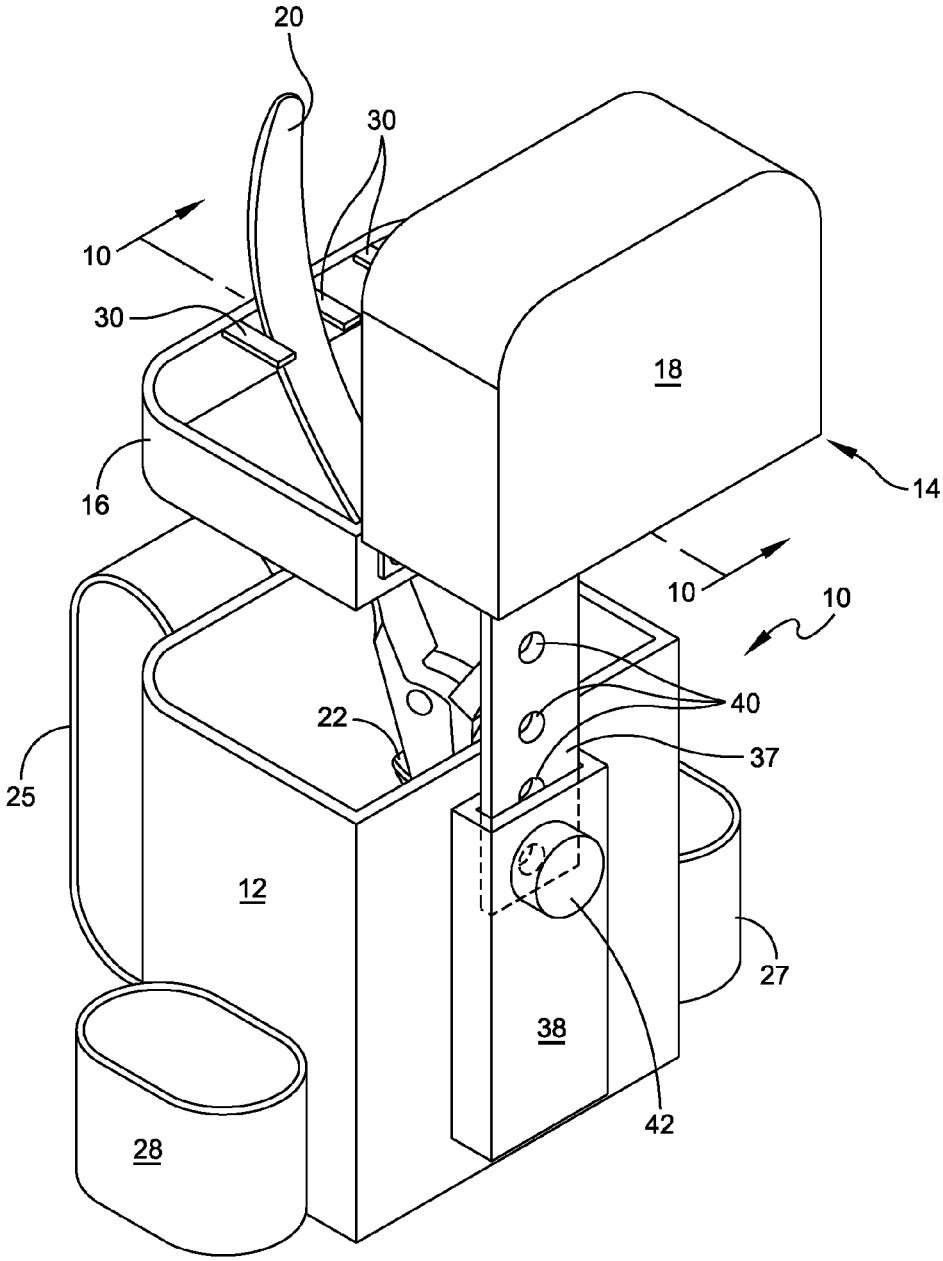
FIG. 9 is a rear perspective view of the holder of the present invention furthermore illustrating the ability for lifting the top portion thereof.
Figure 10:
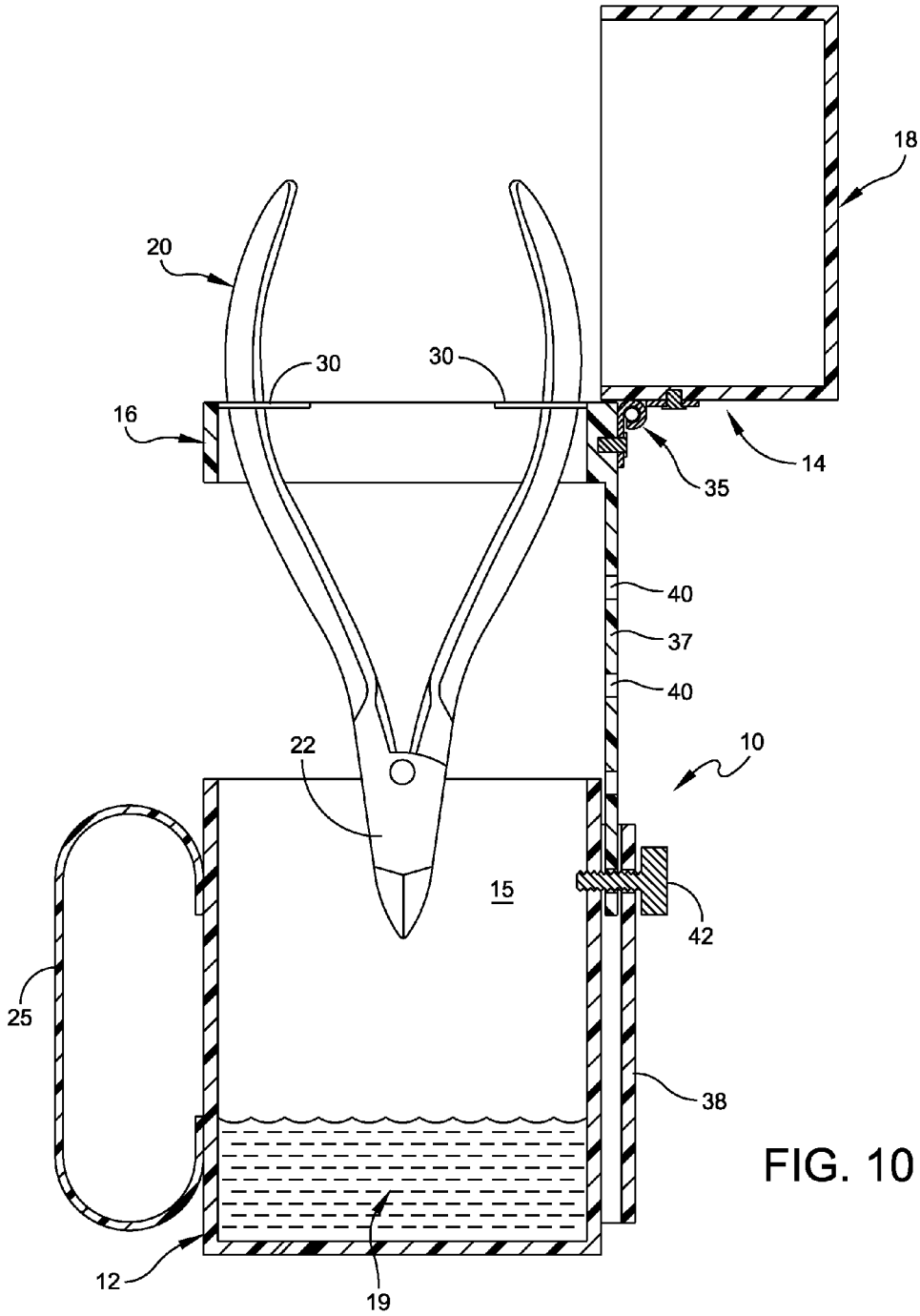
FIG. 10 is a cross-sectional view similar to that shown in FIG. 6 but with the lid assembly elevated and the cover piece open.
Figure 11:
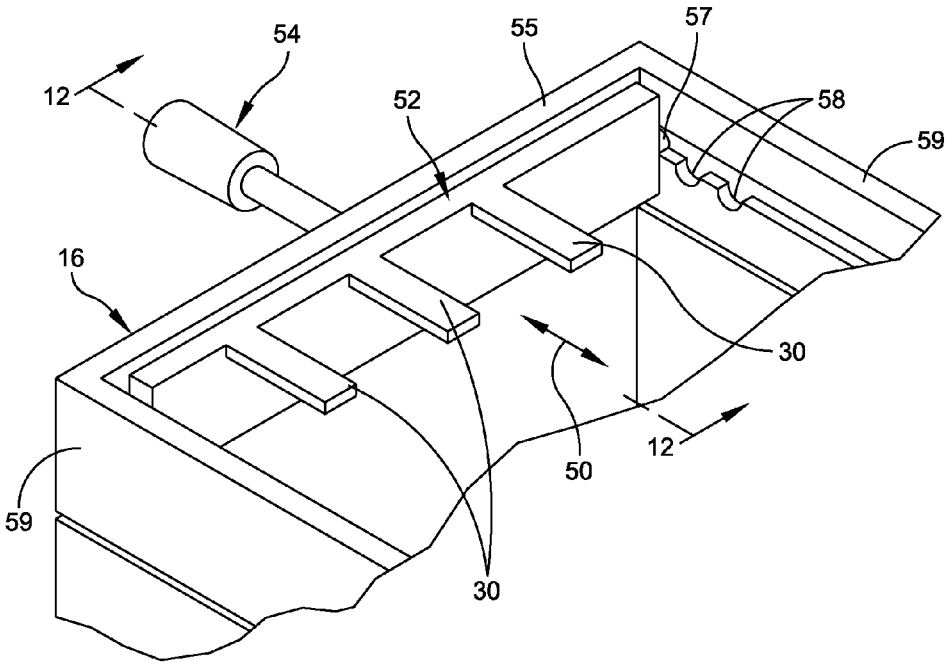
FIG. 11 is a fragmentary perspective view showing an alternate feature of the present invention in which the support fingers are adjustable.

Reference to FIG. 2 illustrates the extension 37 fully engaged into the retainer 38. A fastener 42 is shown securing the extension 37 in place. This holds the intermediate piece 16 in a fixed position but enables the cover piece 18 to be pivoted between the closed position as illustrated in FIG. 2 and an open position as illustrated in FIG. 3. FIGS. 4-6 also illustrate the cover piece 18 in an open position. Reference is now also made to FIG. 9 for an illustration of the manner in which the intermediate piece 16, by virtue of the extension 37 being attached thereto, can be moved to an elevated position. FIG. 9 shows the fastener 42 then reinserted through the extension 37 to hold the extension 37 in place, and in turn, to hold the entire lid assembly 14 at the elevated position illustrated in FIG. 9. Refer also to the cross-sectional view of FIG. 10 which shows the lid assembly 14 in its elevated position. In that position it is noted that the nail clipper 20 is no longer within the cleaning solution. Thus, it is convenient to be able to have the lid assembly at a lower position for the purpose of soaking the nail clipper and then be able to move the lid assembly to an elevated position such as shown in FIG. 10 so that the cleaning solution can be drained from the tip of the nail clipper 20.

Figure 12:
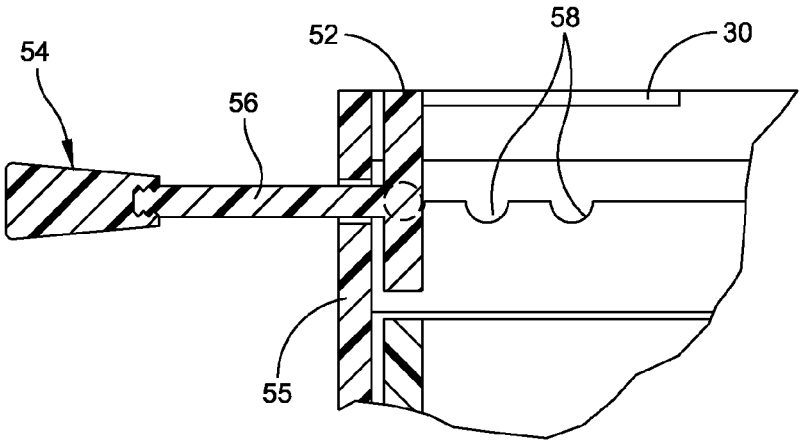
FIG. 12 is a fragmentary cross-sectional view illustrating the fingers in a first position.
Figure 13:
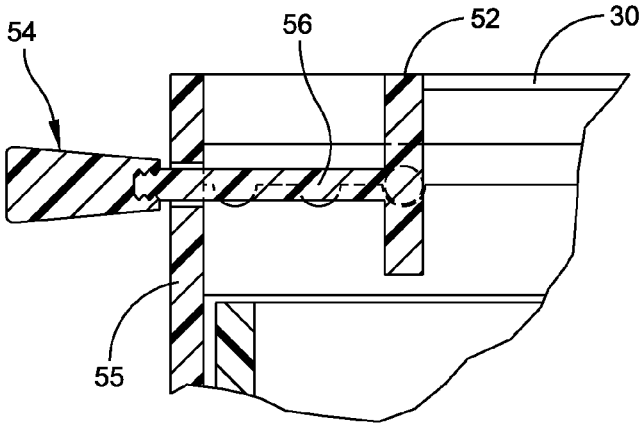
FIG. 13 is a fragmentary cross-sectional view similar to that shown in FIG. 12 but with the fingers moved to a second position.
Figure 14:
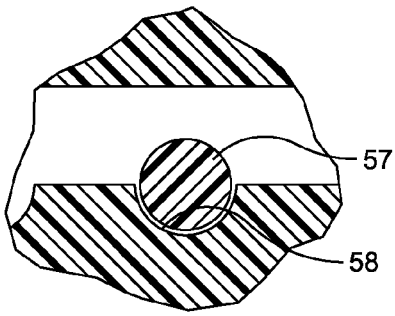
FIG. 14 is a fragmentary cross-sectional view taken through the adjustment knob.
Figure 15:
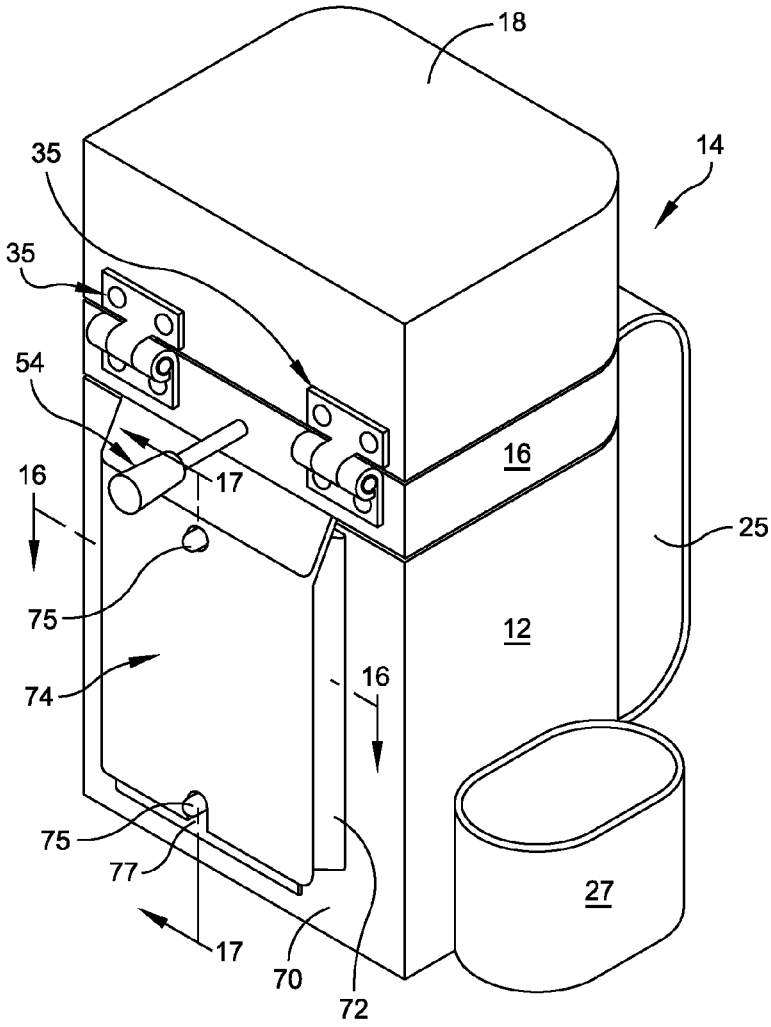
FIG. 15 is a rear perspective view of a further embodiment of the present invention.

As noted in FIGS. 4-6, the fingers 30 illustrated therein are fixed in position attached to opposed sidewalls of the intermediate piece 16. The fingers 30 extend in the same direction on opposite sides and are spaced a like distance apart. However, in accordance with another embodiment of the present invention as illustrated in FIGS. 11-14, the fingers 30 are commonly supported but are capable of moving in the direction of arrow 50 so that at least one of the sets of fingers can be moved toward and away from the other set of fingers. This enables one to support nail clippers of various sizes. In this embodiment of the invention, in order to support the fingers 30, there is provided a common support bar 52 that is able to be moved in the direction of arrow 50 by means of the control knob 54. The control knob 54 is adapted to pass through a hole in the wall 55 and attach to the support bar 52. For this purpose, the control knob 54 has a shaft 56 attached between the knob and the bar 52. The support bar 52 also preferably has opposite end posts 57 shown in the cross-sectional view of FIG. 14. These opposite end posts 57 form a detent means by engaging with respective slots 58 that are disposed along opposed sidewalls 59 of the intermediate piece 16. In addition to the detent means illustrated herein, other forms of detents may be used so that the finger support bar 52 may be set at different positions. Preferably, a single control knob 54 may be employed to close the spacing between the fingers 30 on one side of the intermediate piece and a fixed set of legs on the opposite side of the intermediate piece, such as illustrated in FIG. 3. By changing the position of the support bar 52, one can thus change the spacing between the fingers and thus adjust the spacing so as to accommodate different size tools. In this regard, FIG. 12 shows the support bar 52 in its completely extended position while FIG. 13 shows the support bar 52 moved toward the other set of fingers so as to close the spacing therebetween.

In still another embodiment of the invention not specifically illustrated herein, the fingers 30 may be adjusted as to the spacing therebetween, rather than being fixed in position. This could be accomplished easily by providing a slot in the wall 55 for the fingers to move within so as to change the spacing between adjacent fingers.

Reference is now made to an alternate version of the present invention illustrated in FIGS. 15-18. In this embodiment of the invention some of the same reference characters are used as were previously described in connection with the embodiment illustrated in FIGS. 1-10. Thus, the nail tool holder is defined as comprised of a container that includes a container base 12 and a lid assembly 14. The container base and lid assembly together form a storage chamber for nail tools such as the fingernail clipper illustrated previously. This container also may container a cleaning solution at the bottom of the container base. The primary difference between the embodiments of FIGS. 15-18 and that illustrated in FIGS. 1-10 is that the mechanism for elevating the lid assembly is different in the embodiment of FIGS. 15-18. Even though the structure is different, the principle is similar in that the lid assembly can be moved between at least two opposite positions to provide different types of the lid assembly as illustrated in respective FIGS. 17 and 18.

Figure 16:
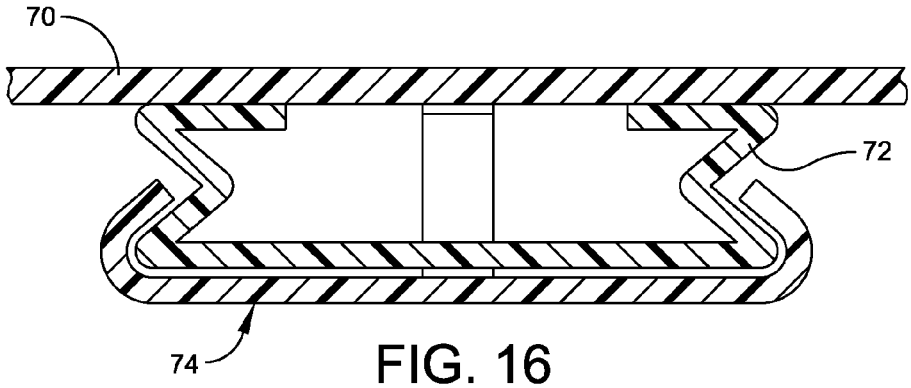
FIG. 16 is a cross-sectional view taken along line 16-16 of FIG. 15.
Figure 17:
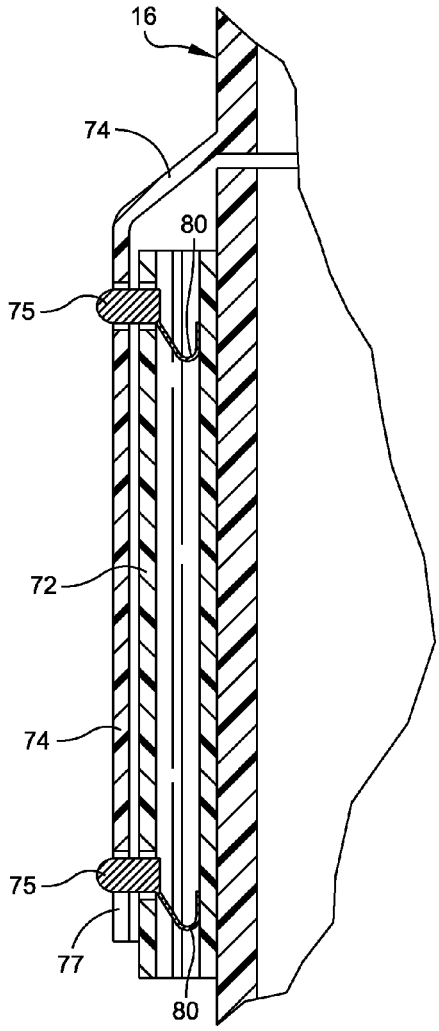
FIG. 17 is a cross-sectional view taken along line 17-17 of FIG. 15.
Figure 18:
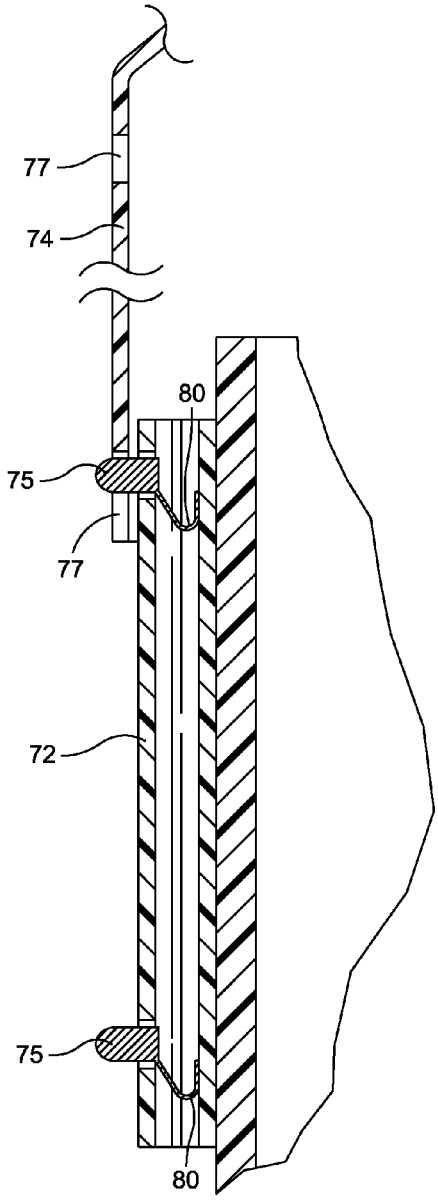
FIG. 18 is a cross-sectional view similar to that shown in FIG. 17 but with the lid assembly elevated.

In the embodiment of FIGS. 15-18, at the rear wall 70 of the container base 12, there is provided a receiver 72 that has the cross-sectional shape illustrated in FIG. 16 and that is adapted to mate with the extension 74. The extension 74, as illustrated in FIGS. 17 and 18, is meant to attach to the intermediate piece 16. The extension 74 engages with the receiver 72. The receiver 72 is firmly attached to the rear wall 70 of the container base 12. In order to hold the extension 74 in the opposed positions illustrated in FIGS. 17 and 18, there are provided a pair of latches 75 that are spacedly disposed extending from support holes of the receiver 72 and for respective engagement with slots of the extension 74. In FIG. 17 the pair of latches 75 engage with a like positioned pair of holes 77 in the extension 74. Each of the latches 75 preferably has an associated spring 80 for biasing the latch 75 to an outer position for engagement with the holes 77.

FIG. 17 is a cross-sectional view illustrating the extension 74 in its lowermost position with both of the latches 75 engaging corresponding holes in the extension 37. FIG. 18 illustrates the position wherein the latches 75 have been moved inwardly to disengage from the extension 74. The extension 74 may then be raised to the position illustrated in FIG. 18 wherein one of the latches 75 engages with a lowermost hole 77 in the elongated extension 74.

Reference is now made to still another embodiment of the present invention illustrated in FIGS. 19-22. In this embodiment the nail tool holder is comprised of a container 110 that is preferably constructed of a lightweight plastic material. The container 110 includes a container base 112 and a lid assembly 114. The lid assembly 14 may be considered as comprised of a single cover. The container base 112 may be considered as comprised of a lower section 112A and an intermediate section 112B. These two sections may be integrally formed. The base section 112A includes the handle 116. The handle 116 is of a curved shape and may be integrally formed with one of the sidewalls of the container base. The lid assembly 114 is connected to the container base 112 by means of a hinge 118. The hinge 118 may take upon a variety of different forms.

Figure 19:
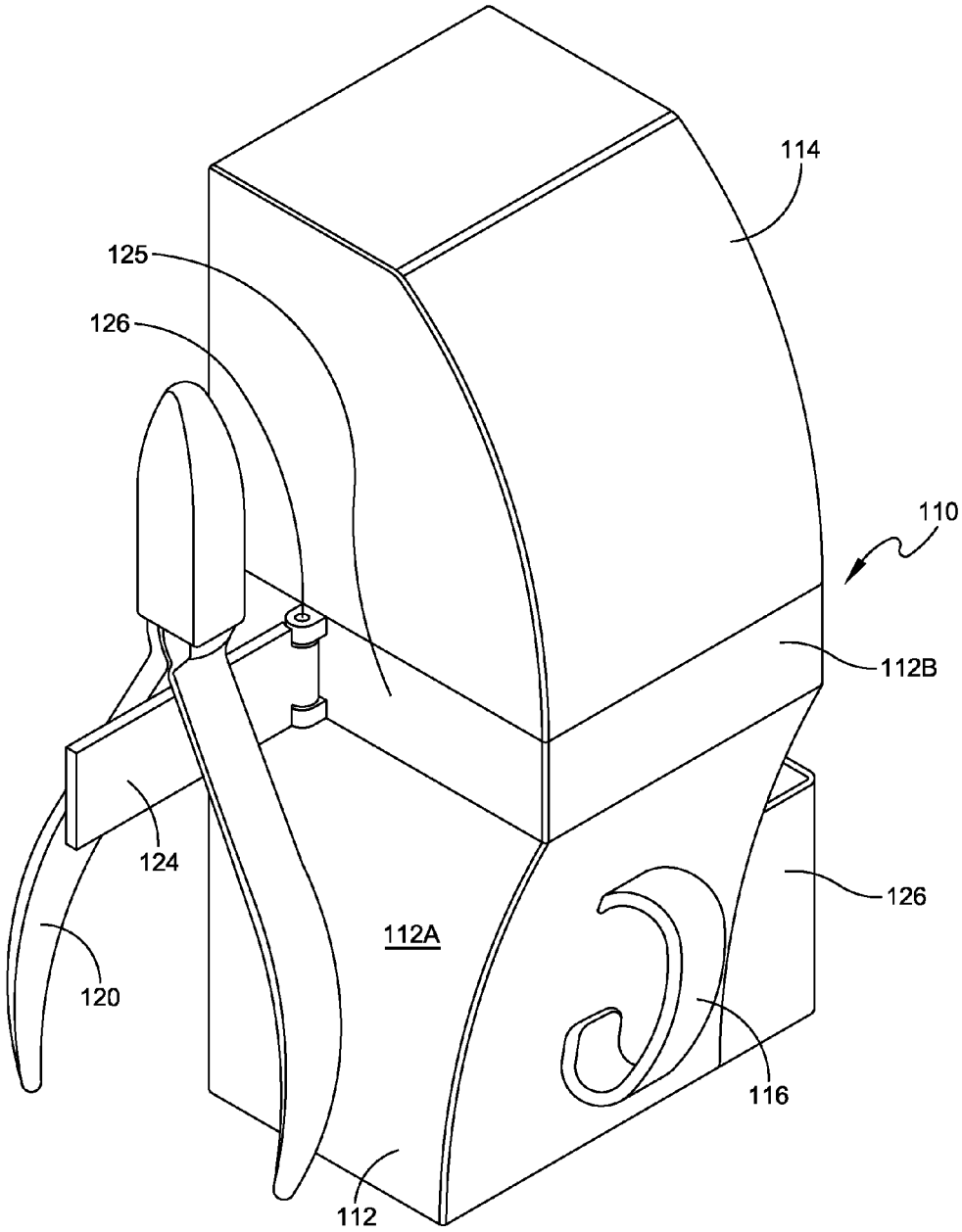
FIG. 19 is a perspective view of an alternate embodiment of the present invention.
Figure 21:
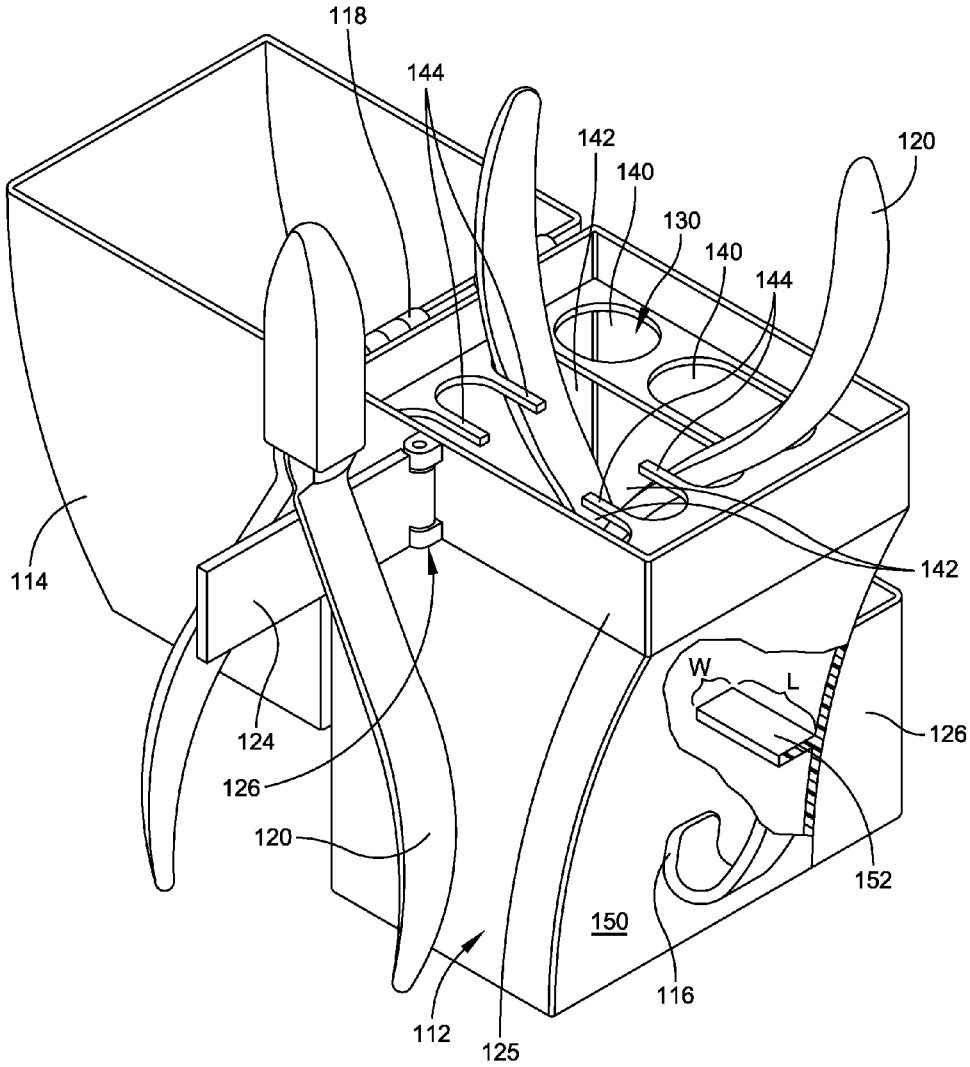
FIG. 21 is a perspective view like that illustrated in FIG. 19 but with the lid open showing details of the slotted structure for supporting tools, as well as a cutaway portion to illustrate the internal shelf.
Figure 22:
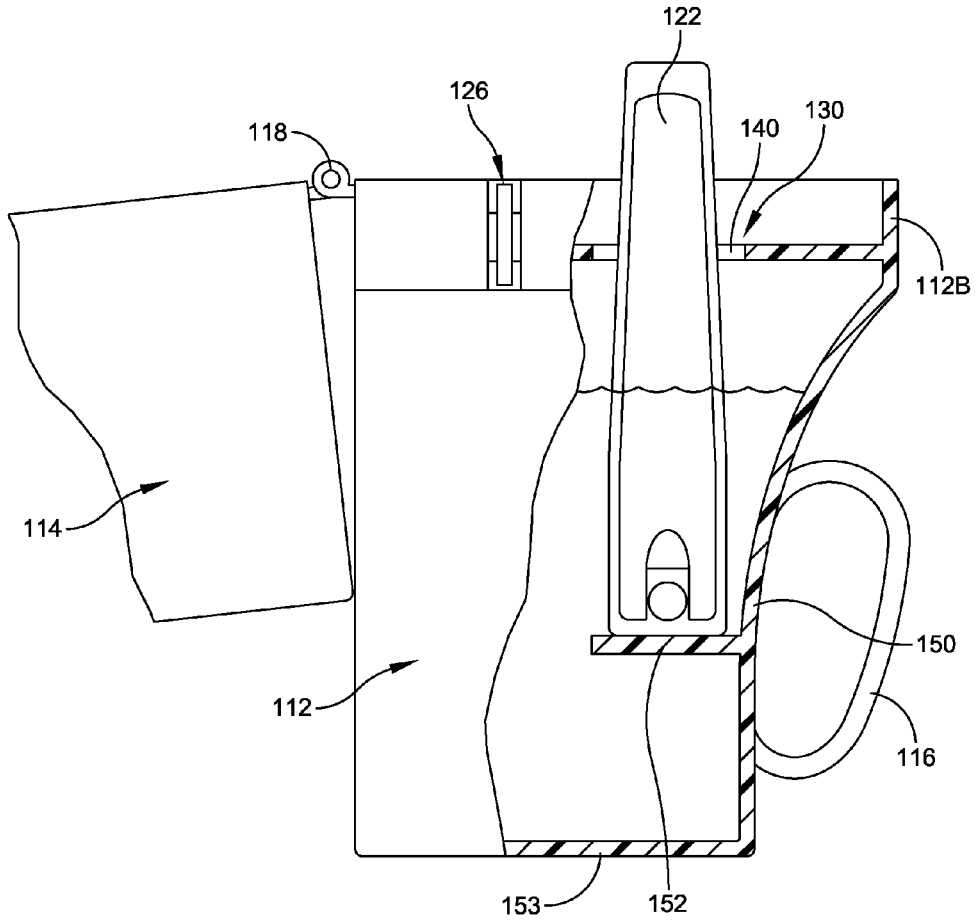
FIG. 22 is a side elevation view taken from the side opposite to that shown in FIG. 20 and moreover illustrating a conventional nail clipper passing through the slotted structure and resting upon the shelf.

The container base 112 and the lid assembly 114 together form an internal storage chamber for accommodating nail tools that include, but are not limited to, a fingernail clipper. Refer to FIGS. 19 and 21 for a pliers-type nail clipper 120. FIG. 22 also shows a more conventional nail clipper at 122. The open container perspective view of FIG. 21 shows one of the nail tools 120 supported by the slotted structure 130. The perspective view of FIG. 21 also shows a second one of the tools supported by the support bar 124. The support bar 124 is connected to a sidewall 125 by a pivot connection shown at 126 in FIGS. 19 and 21. FIG. 21 illustrates the support bar 124 in its pivoted outwardly position. In that position the tool 120 is readily supported by the support bar 124, as illustrated in FIG. 21. In FIGS. 19 and 21, the support bar 124 is shown in its outwardly pivoted position. The support bar 124 may also be pivoted inwardly so that it rests against the sidewall 125 when not in use.

Figure 20:
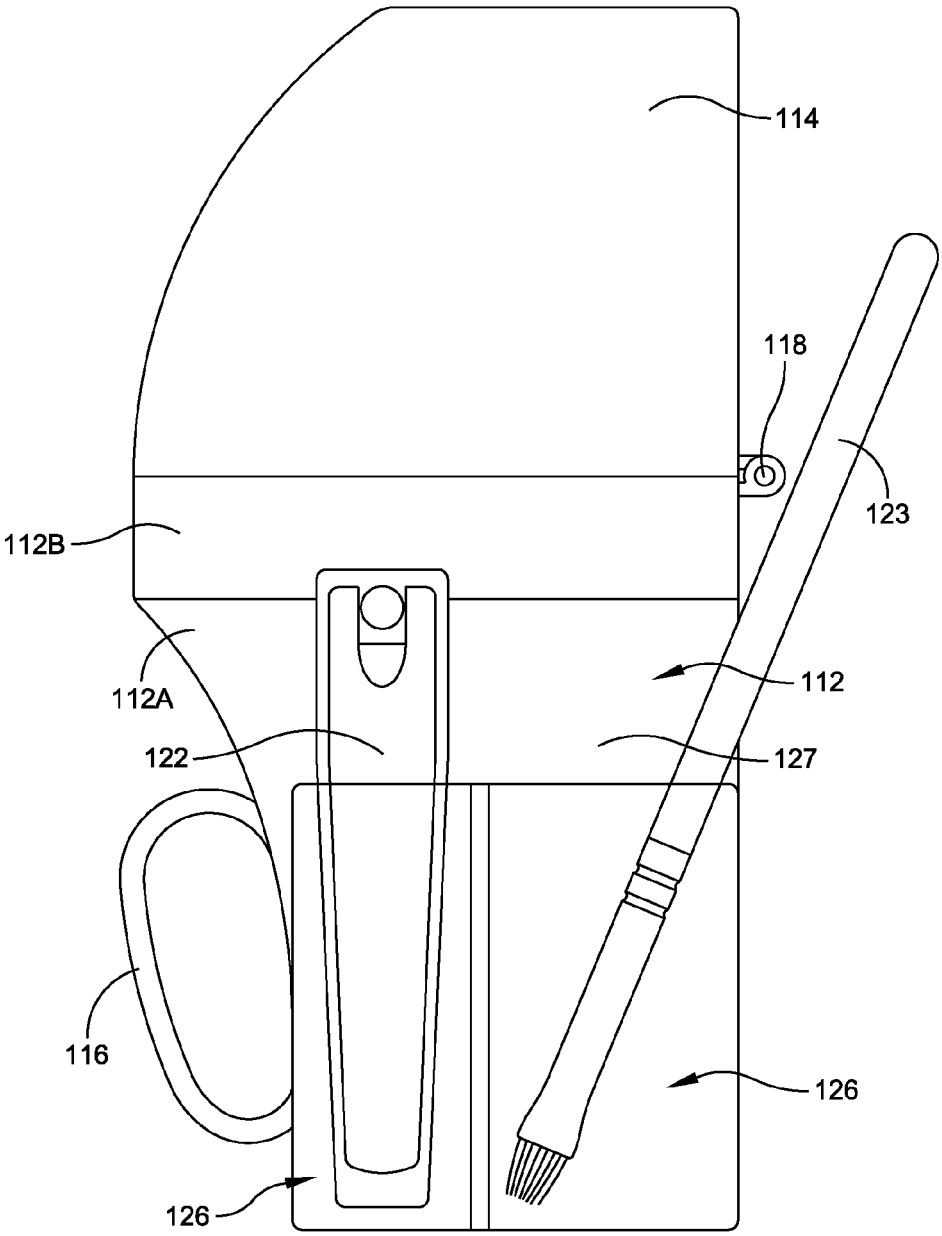
FIG. 20 is a side elevation view taken from the opposite side showing the two external compartments.

In the embodiment illustrated in FIGS. 19-21, on a sidewall opposite to the support bar 124, such as illustrated in FIG. 20, there are a pair of contained compartments 126. FIGS. 19 and 21 also show an edge of one of the compartments 126. Each of these compartments 126 is open only at its top end for receiving one of the nail tools. These compartments 126 are disposed on a sidewall 127 of the container base. In the side view of FIG. 20, a nail clipper 122 is shown disposed within the left hand compartment 126 and, within the right hand compartment 126 in FIG. 20 there is shown an elongated brush tool 123.

Reference is now made to FIGS. 21 and 22 for an illustration of the slotted structure 130 which is supported at the intermediate section 125. The slotted structure 130 is a panel that is fixed in position at the intermediate section 125 and that is provided with a series of openings, as illustrated. The slotted structure 130 may include two aligned slots 140, as well as what may be termed open slots 142. These open slots define a plurality of fingers 144 that essentially extend from a sidewall of this intermediate piece including opposite sets of fingers extending from opposite side walls of the intermediate piece. The slots 140 are arcuate in shape particularly at their ends and also the fingers 144 define arcuate ends of the open slots of the slotted structure 130. Refer to FIG. 21 where the tool 120 is shown extending within one of these slots with the handles resting within arcuate ends of the slot. The tool structure is such that the tool is retained within the slot and if the container is filled with a cleaning or disinfecting solution, then the ends of the tool extend into this solution for cleaning or disinfecting purposes.

The closed slots 140 are also available for receiving a nail clipper such as the clipper 122 illustrated in FIG. 22. Also, in accordance with the container structure of the present invention, at the sidewall 150 there extends a shelf 152. This shelf 152 may extend under both of the slots 140 illustrated in FIG. 21, or, as illustrated in FIG. 22, the shelf 152 is essentially coterminous with the length of the right hand slot 140. It can be seen that the shelf 152 is disposed at a location off of the bottom wall 153 at a distance that allows a portion of the top of the clip of 122 to extend above the intermediate section 112B so that the nail clipper can be easily grasped. Preferably, the shelf 152 extends only under one of the slots 140. This enables the other slot 140 to receive an elongated tool such as the brush tool 123 illustrated in FIG. 20. FIG. 21 illustrates a length of the shelf 152 by length L comparable to the length of the right hand slot 140. Shelf 152 may also have a width W comparable to the width of the right hand slot 140.

Thus, there are several important features previously described in connection with the present invention. Some of these features include the ability to move at least one of the finger arrays so as to change the spacing between one set of fingers and the opposed set of fingers. This enables ready receipt of tools of different size, particularly nail clippers of different size. Another feature relates to the ability to not only have a hinged cover, but also have an intermediate piece for supporting the cover and that can be positioned at different elevations for the purpose of supporting tools at different elevations. Still a further feature of the present invention is the use of multiple storage compartments for items so that items can be stored both within the container as well as in outside compartments associated with the container.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A nail tool holder comprising:

a container that includes a container base and a lid assembly that together form a storage chamber area for nail tools;

said container for containing a cleaning solution at a bottom of the chamber; said lid assembly including an intermediate piece and a cover piece that is movable relative to said intermediate piece between open and closed positions;

a slotted structure supported from said intermediate piece and for supporting at least one nail tool therefrom;

at least one hinge for supporting the cover piece from the intermediate piece so that the cover piece is movable relative to the intermediate piece between the open and closed positions;

the container base including multiple contiguously connected walls forming an upper peripheral substantially planar edge that defines part of the chamber area and defines a base footprint;

the intermediate piece also including multiple contiguously connected walls forming respective upper and lower peripheral substantially planar edges that define therebetween part of the chamber area and defines an intermediate piece footprint;

the cover piece also including multiple contiguously connected walls forming a lower peripheral substantially planar edge that defines part of the chamber area and defines a cover piece footprint;

the footprints of the base, intermediate piece and cover piece being substantially the same;

and a height adjustment mechanism for enabling adjustment of the intermediate piece to different heights above the container base;

the height adjustment mechanism including an extension that extends downwardly from the intermediate piece and one of a retainer and receiver for accepting the extension;

the position of the extension being adjustable to at least two spaced apart fixed positions in order to adjust the height of the intermediate piece.

2. The nail tool holder of claim 1 wherein the slotted structure includes a plurality of fingers extending from a sidewall of the intermediate piece.

3. The nail tool holder of claim 2 including opposite sets of fingers extending from opposite walls of the intermediate piece.

4. The nail tool holder of claim 3 wherein the fingers of both sets are spaced from each other along the respective wall so that the handle of a nail tool can be supported between adjacent fingers with the tip of the nail tool directed downwardly.

5. The nail tool holder of claim 4 wherein the fingers are adjustable relative to the spacing therebetween so as to accommodate different size nail tools.

6. The nail tool holder of claim 1 wherein when the cover piece is closed, the lower peripheral edge of the cover piece rests on and is aligned with the upper peripheral edge of the intermediate piece, and when the intermediate piece is in a lowermost position, the lower peripheral edge of the intermediate piece rests on and is aligned with the upper peripheral edge of the base.

7. The nail tool holder of claim 1 wherein the extension includes an elongated extension arm having spaced apart holes therein and a slotted retainer for receiving the elongated extension arm, the slotted retainer attached to the base.

8. The nail tool holder of claim 1 wherein the extension includes a planar member having turned ends and a receiver for mating with the planar member turned ends.

9. The nail tool holder of claim 1 including a fastener for holding the extension at a predetermined elevation.

10. A nail tool holder comprising:

a container that includes a container base and a lid assembly that together form a storage chamber for nail tools including, but not limited to, a fingernail clipper;

a slotted structure for supporting at least one nail tool from the lid assembly so that the nail tool can be supported at a handle of the nail tool;

said lid assembly including an intermediate piece and a cover piece that is movable relative to said intermediate piece;

said slotted structure supported from said intermediate piece;

said lid assembly including an intermediate piece and a cover piece that is movable relative to said intermediate piece between open and close positions;

at least one hinge for supporting the cover piece from the intermediate piece so that the cover piece is movable relative to the intermediate piece between the open and closed positions;

the container base including multiple contiguously connected walls forming an upper peripheral substantially planar edge that defines part of the chamber area and defines a base footprint;

the intermediate piece also including multiple contiguously connected walls forming respective upper and lower peripheral substantially planar edges that define therebetween part of the chamber area and defines an intermediate piece footprint;

the cover piece also including multiple contiguously connected walls forming a lower peripheral substantially planar edge that defines part of the chamber area and defines a cover piece footprint;

the footprints of the base, intermediate piece and cover piece being substantially the same;

and a height adjustment mechanism for enabling adjustment of the intermediate piece to different heights above the container base;

the height adjustment mechanism including an extension that extends downwardly from the intermediate piece and one of a retainer and receiver for accepting the extension;

the position of the extension being adjustable to at least two spaced apart fixed positions in order to adjust the height of the intermediate piece;

and a support bar that extends outwardly from a container base wall.

11. The nail holder of claim 10 wherein said container contains a cleaning solution at a bottom of the chamber.

12. The nail tool holder of claim 10 wherein the slotted structure includes a plurality of fingers extending from a wall of the intermediate piece including opposite sets of fingers extending from opposite walls of the intermediate piece, and wherein the fingers of both sets are spaced from each other along the respective wall so that the handle of a nail tool can be supported between adjacent fingers with the tip of the nail tool directed downwardly.

13. The nail tool holder of claim 10 wherein the slotted structure defines a plurality of parallel disposed slots with at least one of said slots extending in a continuous loop, and at least one other slot is interrupted to define fingers that extend toward each other.

14. The nail tool holder of claim 10 wherein the support bar is pivotally supported from a wall of the intermediate piece.

15. The nail tool holder of claim 10 including a shelf disposed in the container base spaced above a bottom of the container base and positioned relative to the slotted structure so that a tool supported by said slotted structure rests on said shelf.

16. The nail tool holder of claim 10 including a pair of side compartments supported from a sidewall for the container base for holding tools outside of the container base.

17. The nail tool holder of claim 16 including a shelf disposed in the container base spaced above a bottom of the container base and positioned relative to the slotted structure so that a tool supported by said slotted structure rests on said shelf, and a pair of side compartments supported from a sidewall for the container base for holding tools outside of the container base, and wherein the support bar is pivotally supported from a sidewall of the intermediate piece.

18. The nail tool holder of claim 10 wherein when the cover piece is closed, the lower peripheral edge of the cover piece rests on and is aligned with the upper peripheral edge of the intermediate piece, and when the intermediate piece is in a lowermost position, the lower peripheral edge of the intermediate piece rests on and is aligned with the upper peripheral edge of the base.

19. The nail tool holder of claim 10 wherein the extension includes an elongated extension arm having spaced apart holes therein and a slotted retainer for receiving the elongated extension arm.

20. The nail tool holder of claim 10 wherein the extension includes a planar member having turned ends and a receiver for mating with the planar member turned ends.

* * * * *